US007467580B2

(12) United States Patent
Young, III et al.

(10) Patent No.: US 7,467,580 B2
(45) Date of Patent: Dec. 23, 2008

(54) CARRIER FOR AMMUNITION HANDLING SYSTEM

(75) Inventors: John L. Young, III, Essex, VT (US); Valery Soroka, Essex Jct, VT (US)

(73) Assignee: General Dynamics Armament and Technical Products, Inc., Burlington, VT (US)

( * ) Notice: Subject to any disclaimer, the term of this patent is extended or adjusted under 35 U.S.C. 154(b) by 429 days.

(21) Appl. No.: 11/108,114

(22) Filed: Apr. 18, 2005

(65) Prior Publication Data

US 2006/0230915 A1 Oct. 19, 2006

(51) Int. Cl.
*F41A 9/34* (2006.01)

(52) U.S. Cl. ..... 89/45; 89/35.01

(58) Field of Classification Search ..... 89/35.01, 89/45

See application file for complete search history.

(56) References Cited

U.S. PATENT DOCUMENTS 2,437,425 A 3/1948 Goodhue et al.
2,708,391 A 5/1955 Molins et al.
5,259,290 A * 11/1993 Pehker ..... 89/35.01
6,681,678 B2 1/2004 Eriksson

OTHER PUBLICATIONS

PCT/US06/14423, International Search Report mailed Aug. 17, 2007.

* cited by examiner

*Primary Examiner*—Stephen M Johnson
(74) *Attorney, Agent, or Firm*—Hunton & Williams

(57) ABSTRACT

The invention provides an ammunition carrier for retaining ammunition. The ammunition carrier includes a stationary carrier body portion disposed about a space in which to retain the ammunition; and a rotating carrier body portion disposed about the space and pivotally. attached to the stationary carrier body portion. The stationary carrier body portion and the rotating carrier body portion collectively form a cover assembly to secure the ammunition. The ammunition carrier further includes a locking mechanism, the locking mechanism pivotally attached to the rotating carrier body portion, the locking mechanism (1) engageable, in an engaged position, with the stationary carrier body portion so as to prevent rotation of the rotating carrier body portion relative to the stationary carrier body portion; and (2) disengageable, in a disengaged position, with the stationary carrier body portion so as to allow rotation of the rotating carrier body portion relative to the stationary carrier body portion.

11 Claims, 15 Drawing Sheets

(actuator with the ammunition carrier closed – see also Fig. 9)

(closed position)

(Open position)

(actuator with the ammunition carrier closed – see also Fig. 9)

(actuator with the ammunition carrier closed – see also Fig. 8)

(actuator with the ammunition carrier open – see also Fig. 11)

(actuator with the ammunition carrier open – see also Fig. 10)

Ammunition handling system 90

(actuator with the ammunition carrier closed – see also Fig. 9)

CARRIER FOR AMMUNITION HANDLING SYSTEM

FIELD OF THE INVENTION

The systems and methods of the invention relate to ammunition carriers used in an ammunition handling system.

BACKGROUND OF THE INVENTION

Various ammunition carriers are known in the art. FIG. 1 shows one known ammunition carrier 10. The ammunition carrier 10 includes an assembly that retains the ammunition until it is desired to unload the ammunition. Ammunition removal and uploading is accomplished by a hand-off mechanism that includes forks, gates and cams as shown in FIG. 1. The ammunition carrier 10 is typically transported along with other ammunition carriers in an ammunition handling system. The particular ammunition carrier 10 is transported in the ammunition handling system until it is disposed in a position for unloading. The ammunition will then be released from the fork via a cam arrangement effecting actuation of a gate. The gate as shown in FIG. 1 effects the release of the ammunition from the ammunition carrier 10. The fork cam is provided to engage with a suitable cam surface, i.e., so as to effect rotation of the fork and gate cam, as shown in FIG. 1.

FIG. 2 shows a further known ammunition carrier 20. The ammunition carrier 20 includes mechanically preloaded spring clips. The clips secure the ammunition to the ammunition carrier 20. However, there are various constraints to the "snap-in" ammunition carrier design. Such design is typically limited to a horizontal magazine orientation. As can be appreciated, there is a tight tolerance in the manufacture of the clips. Further, the clips are subject to fatigue. A further constraint is that the "snap-in" ammunition carrier design typically requires a hand-off mechanism to remove or upload the ammunition.

Accordingly, known ammunition carriers suffer from various drawbacks associated with ease of use, securement of the ammunition during various phases of manipulation of the ammunition, structural soundness, and additional weight and cost associated with hand-off mechanism. The systems and methods of the invention address these and other drawbacks of known arrangements.

SUMMARY OF THE INVENTION

The invention provides an ammunition carrier for retaining ammunition. The ammunition carrier includes a stationary carrier body portion disposed about a space in which to retain the ammunition; and a rotating carrier body portion disposed about the space and pivotally attached to the stationary carrier body portion. The stationary carrier body portion and the rotating carrier body portion collectively form a cover assembly to secure the ammunition. The ammunition carrier further includes a locking mechanism, the locking mechanism pivotally attached to the rotating carrier body portion, the locking mechanism (1) engageable, in an engaged position, with the stationary carrier body portion so as to prevent rotation of the rotating carrier body portion relative to the stationary carrier body portion; and (2) disengageable, in a disengaged position, with the stationary carrier body portion so as to allow rotation of the rotating carrier body portion relative to the stationary carrier body portion.

BRIEF DESCRIPTION OF THE DRAWINGS

The present invention can be more fully understood by reading the following detailed description together with the accompanying drawings, in which like reference indicators are used to designate like elements, and in which.

DETAILED DESCRIPTION OF THE EMBODIMENTS

Figure 1:
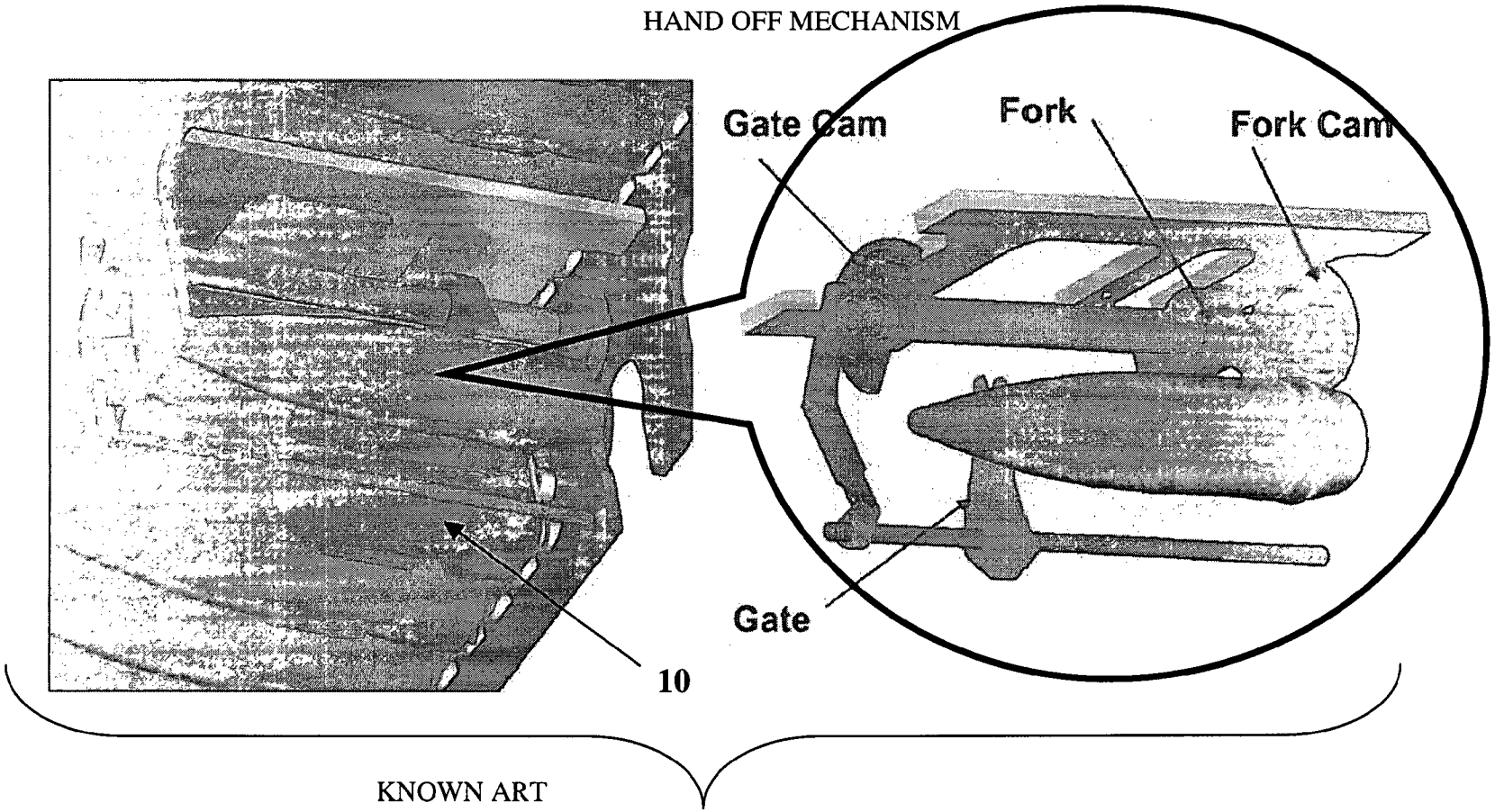
FIG. 1 is a perspective view showing a known ammunition handling system.
Figure 2:
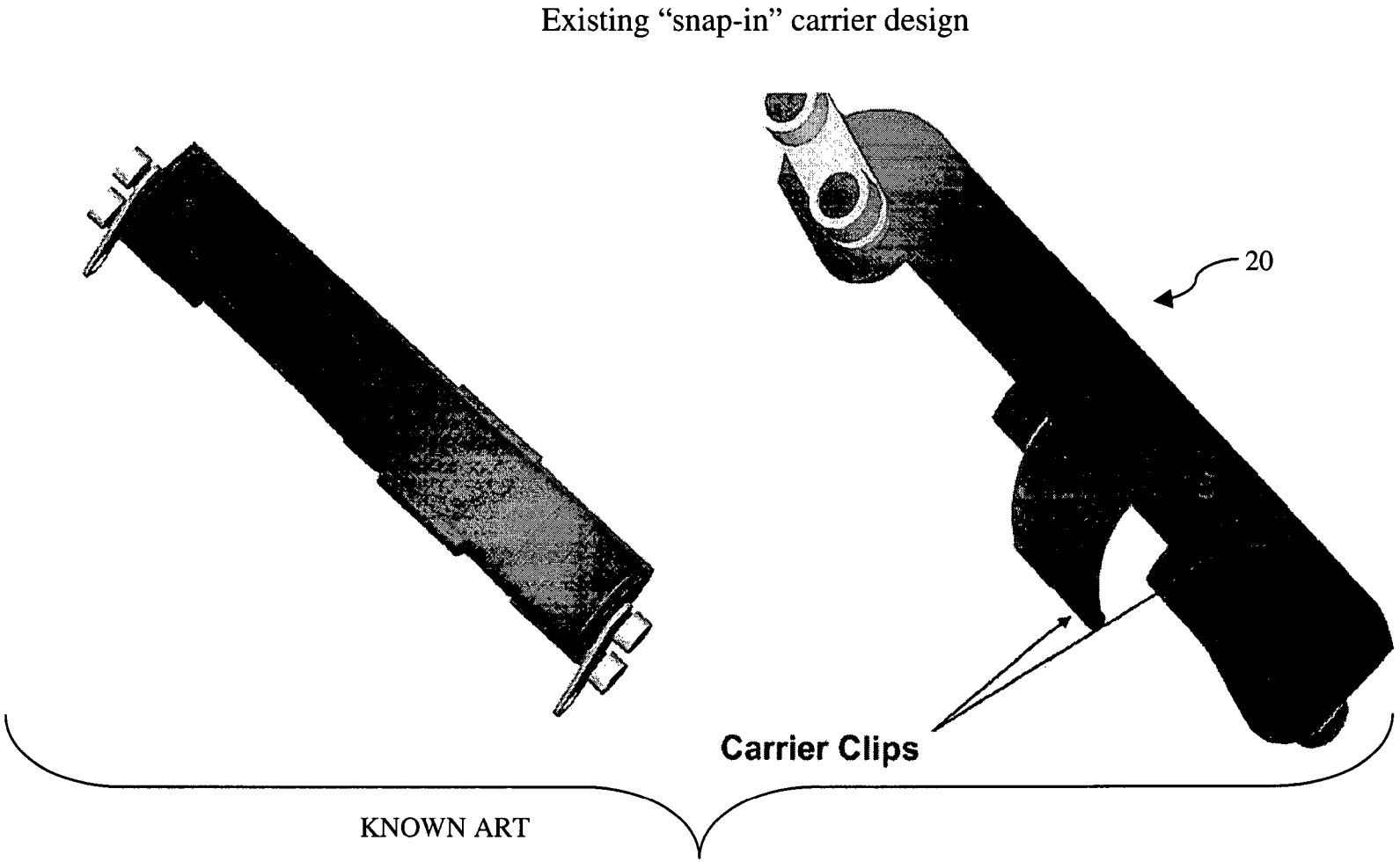
FIG. 2 is a perspective view showing a known ammunition carrier with carrier clips.

This invention relates to a carrier for an ammunition handling system, such as an ammunition handling system for tank or artillery ammunition. As used herein, any term in the singular may be interpreted to be in the plural, and alternatively, any term in the plural may be interpreted to be in the singular.

In accordance with embodiments, the design of the invention provides optimized control of an ammunition round in any position within the magazine. In implementation of the ammunition carrier typically a serpentine type magazine may be used. However, the ammunition carrier may be implemented in other types of systems. The ammunition carrier design provides entry and exit locations in the magazine for convenient round uploading and removal.

As discussed further below, in accordance with one embodiment of the invention, each carrier includes two halves that can rotate around an axis of rotation to allow access to the ammunition. The carrier opening and closing can be done manually, or can be mechanically actuated. The carrier has a safety feature to prevent ammunition from accidentally falling out when the carrier opens.

Described in summary here, the various features of the carrier are discussed in detail below. The carrier design described herein may be used to work in a serpentine style magazine. This carrier is intended to optimize control of ammunition in the various positions within the magazine. The carrier includes two halves, which rotate around a common axis of rotation. The carrier pieces, i.e., the halves of the carrier are kept in a closed position by a locking mechanism. In the closed position, the carrier retains ammunition disposed inside the carrier. The carrier may handle ammunition in either a vertical or horizontal orientation. In the open position, the carrier allows for ammunition removal by releasing a safety retention feature, i.e., a cap, to prevent ammunition from falling out of the carrier. Carrier opening/closing can be done manually or via an automated mechanical locking arrangement.

As described below, the ammunition carrier is traveled from one location (e.g., a load location) to another location (e.g., an unload location), along with a plurality of other ammunition carriers that go to make up the serpentine ammunition handling system. During travel, the ammunition carrier is intended to remain closed at all times in the serpentine of the vertical or horizontal magazine.

At a specific location within the magazine, an actuator engages the carrier opening mechanism, releases the locking mechanism, and rotates the rotating portion of carrier body, i.e., what may be characterized as one-half of the ammunition carrier. Accordingly, the ammunition becomes exposed to the loader, but still remains secured within the carrier by the safety feature, i.e., the cap, being engaged in closed position. If the ammunition removal is intended, the carrier safety cap is released by means of rotating gears as part of a safety feature mechanism. After the safety cap is rotated, with the open side facing the loader, the ammunition can be freely removed from the carrier assembly.

Figure 3:
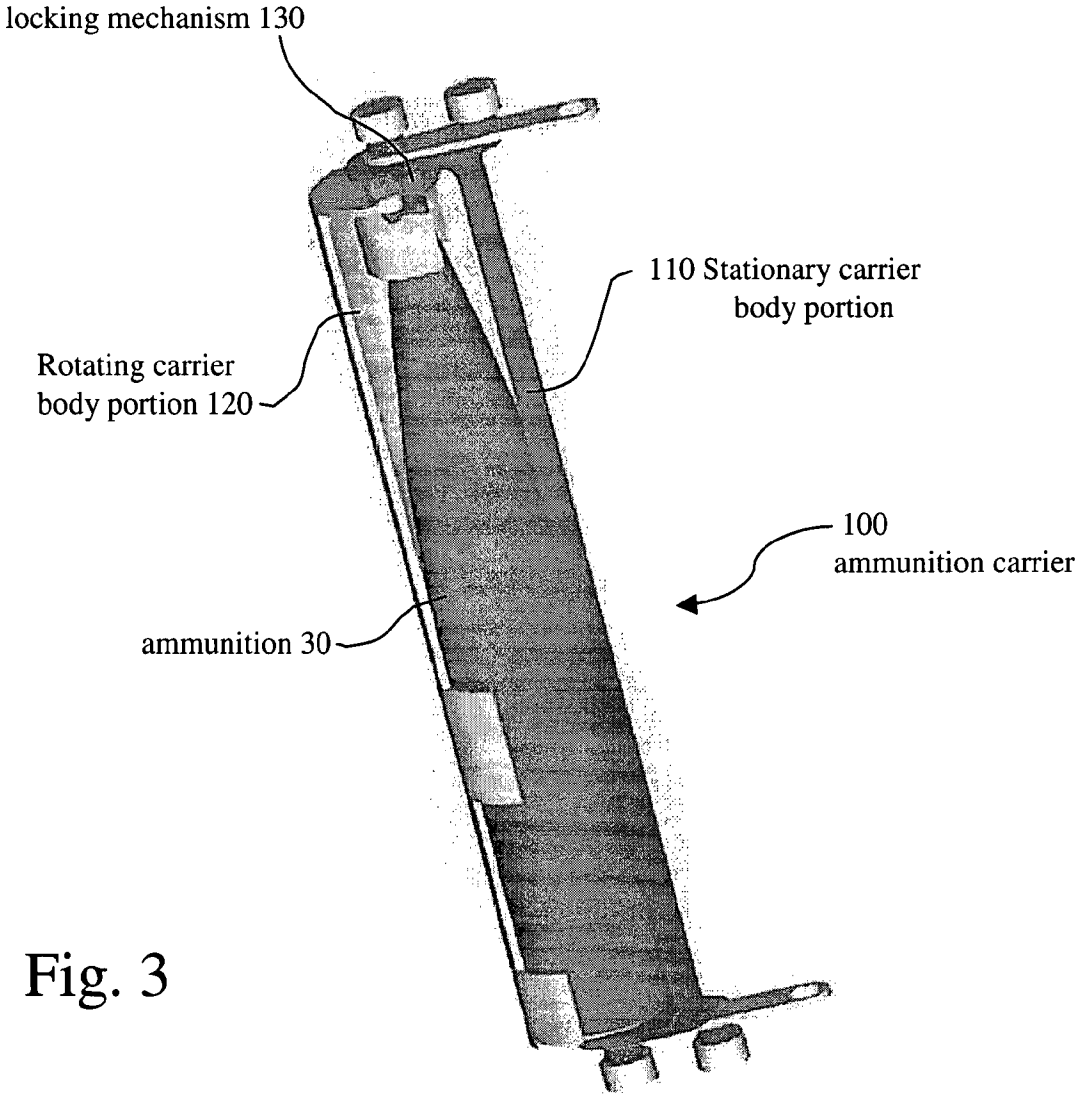
FIG. 3 is a perspective showing an ammunition carrier in accordance with one embodiment of the invention.

Hereinafter, various details of the invention will be described with reference to the drawings. FIG. 3 is a perspective showing an ammunition carrier 100 in accordance with one embodiment of the invention. The ammunition carrier 100 includes a stationary carrier body portion 110 and a rotating carrier body portion 120. The stationary carrier body portion 110 and the rotating carrier body portion 120 might be characterized as two halves of the ammunition carrier 100 that rotate around an axis of rotation to allow access to the ammunition 30.

Figure 4:
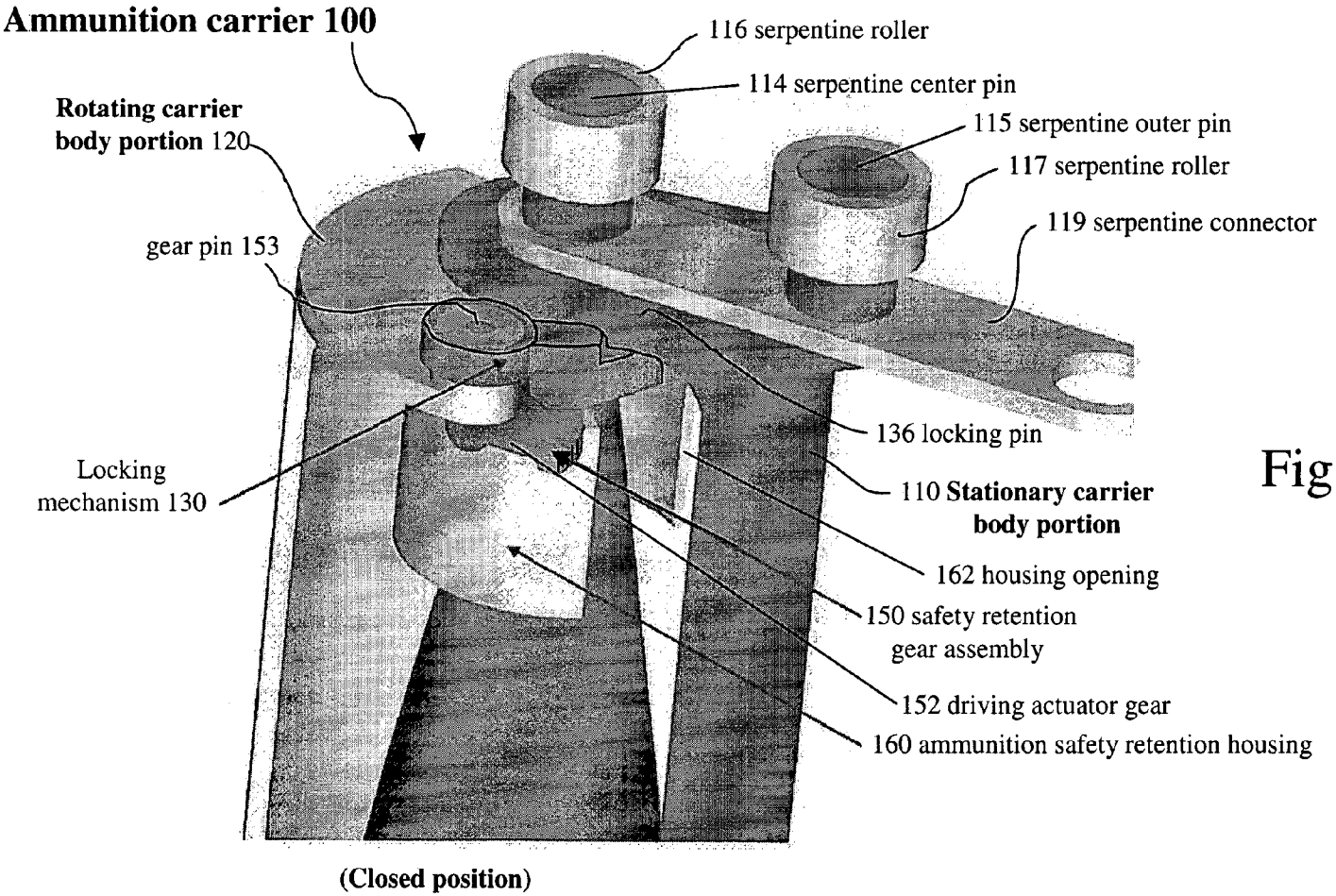
FIG. 4 is a perspective view showing further details of an ammunition carrier in accordance with one embodiment of the invention.

FIG. 4 is a perspective view showing further aspects of the ammunition carrier 100 in accordance with an embodiment. As discussed above, the ammunition carrier 100 includes the stationary carrier body portion 110 and the rotating carrier body portion 120. The ammunition carrier 100 further includes an ammunition safety retention housing 160, which is disposed in the halves (110, 120). Each of the components (110, 120 and 160) rotates around a common axis of rotation. The ammunition safety retention housing 160 may be in the form of an inverted cap with sidewalls, wherein a portion of the sidewall includes an opening.

The ammunition carrier 100 includes a locking mechanism 130. As shown, the locking mechanism 130 is pivotally connected to the rotating carrier body portion 120. The locking mechanism 130 includes a locking pin 136. In a closed position of the ammunition, the locking pin 136 engages with the stationary carrier body portion 110. Accordingly, when the locking pin 136 is engaged with the stationary carrier body portion 110, the rotating carrier body portion 120 cannot rotate relative to the stationary carrier body portion 110.

The ammunition carrier 100 further includes components for attachment of the ammunition carrier 100 to a serpentine ammunition handling system. That is, the ammunition carrier 100 includes serpentine rollers (116, 117). The serpentine roller 116 is mounted on a serpentine center pin 114, which is in turn integrally connected to the stationary carrier body portion 110. Similarly, the serpentine roller 117 is mounted on a serpentine outer pin 115. The rollers (116, 117) guide the ammunition carrier 100 along a suitable track in the ammunition handling system. A serpentine connector 119 is connected to the pins (114, 115). The serpentine connector 119 serves to connect a plurality of the ammunition carriers 100 so as to make up a series of ammunition carriers for an ammunition handling system.

FIG. 4 also shows aspects of the safety retention feature actuating gears 150. The gears 150 include a driving actuator gear 152 (as shown in FIG. 4), as well as a driven actuator gear 154, described below. The driving actuator gear 152 is fixedly mounted on a gear pin 153. Further details of the safety retention feature actuating gears 150 are discussed below.

Figure 5:
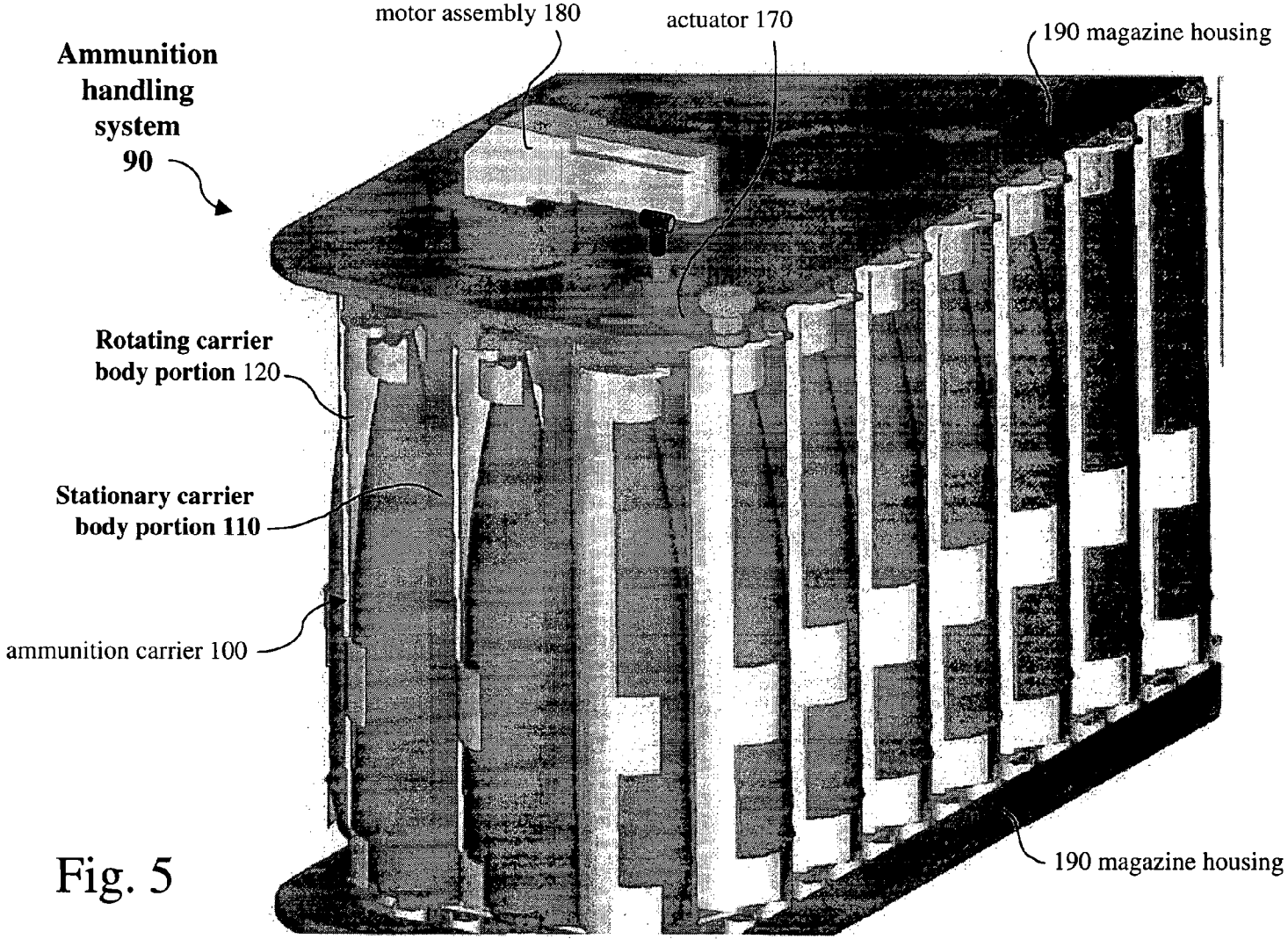
FIG. 5 is a perspective view showing an ammunition handling system with ammunition carrier in accordance with one embodiment of the invention.

FIG. 5 is a perspective view showing an ammunition handling system 190 with ammunition carriers in accordance with one embodiment of the invention. The ammunition handling system 90 includes a plurality of ammunition carriers 100. The ammunition carriers 100 may be arranged in a serpentine arrangement in accordance with one embodiment of the invention. Each ammunition carrier 100 includes a stationary carrier body portion 110 and a rotating carrier body portion 120, as discussed above. The ammunition handling system 90 includes a magazine housing 190. The magazine housing 190 supports the serpentine arrangement of ammunition carriers 100. As shown in FIG. 5, a suitable motor assembly 180 may be used to move the various ammunition carriers 100 in the serpentine magazine housing 190.

The ammunition handling system 90 also includes an actuator 170. The actuator 170 may be used to manually open the ammunition carrier 100 by a human user manipulating the actuator 170 via an actuator handle 173. That is, the actuator 170 opens the rotating carrier body portion 120 (relative to the stationary carrier body portion 110) and rotates the ammunition safety retention housing 160, so that the ammunition may be removed.

Figure 6:
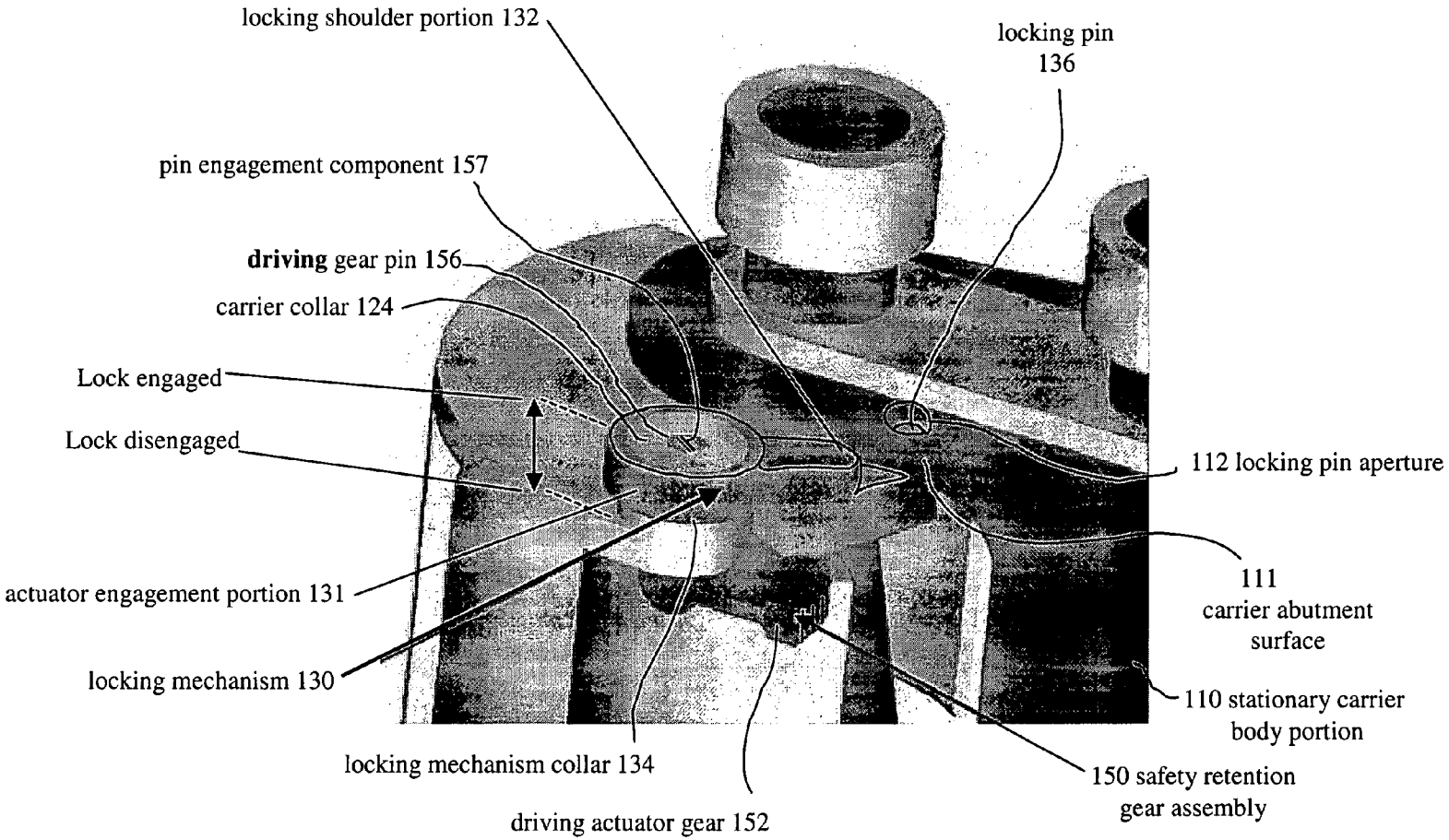
FIG. 6 is a perspective view showing further aspects of an ammunition carrier with locking mechanism in the closed position in accordance with one embodiment of the invention.

FIG. 6 shows further aspects of the locking mechanism 130 in a closed position, i.e., a locked position. As described above, the locking mechanism 130 is pivotally attached to the rotating carrier body portion 120. In the locked position, the locking mechanism 130 is engaged with the stationary carrier body portion 110. Accordingly, in the locked position as shown in FIG. 6, the rotating carrier body portion 120 is not free to rotate relative to the stationary carrier body portion 110.

In the embodiment of FIG. 6, the locking mechanism 130 engages with the stationary carrier body portion 110 via a pin arrangement. That is, the locking mechanism 130 includes a locking pin 136. The locking pin 136 extends into a locking pin aperture 112 in the stationary carrier body portion 110. The locking mechanism 130 is pivotally mounted on the rotating carrier body portion 120. In the embodiment of FIG. 6, the locking mechanism 130 includes a locking mechanism collar 134, which forms an annular portion of the locking mechanism 130. The locking mechanism collar 134 extends around a carrier collar 124. The carrier collar 124 may be integrally formed with the rotating carrier body portion 120.

Further, as described below, the locking mechanism collar 134 is telescopically mounted (and suitably secured) on the carrier collar 124, such that the locking mechanism collar 134 may be moved down relative to the carrier collar 124. The locking mechanism collar 134 might be spring loaded so as to bias the locking mechanism collar 134 up (as shown in FIG. 6).

The movement down of the locking mechanism collar 134 is performed by the actuator 170 and effects the disengagement of the locking pin 136 from the locking pin aperture 112. Accordingly, once the locking pin 136 is disengaged from the locking pin aperture 112, the locking mechanism 130 no longer secures the rotating carrier body portion 120 vis-à-vis the stationary carrier body portion 110, such that the rotating carrier body portion 120 is free to rotate.

As noted above, in accordance with one embodiment of the invention, the locking mechanism 130 may be spring-loaded so as to be biased into the locking position, i.e., biased into the position shown in FIG. 6. In operation, the actuator 170 overcomes the spring bias so as to disengage the locking pin 136 from the locking pin aperture 112.

FIG. 6 also shows aspects of a safety retention gear assembly 150. The safety retention gear assembly 150 includes a driving actuator gear 152, as shown. The driving actuator gear 152 is fixed in a non-rotatable manner to a driving gear pin 156. Accordingly, rotation of the driving gear pin 156 directly results in rotation of the driving actuator gear 152. The driving gear pin 156, in accordance with one embodiment of the invention, is provided with a pin engagement component 157 to effect rotation of the driving gear pin 156. The pin engagement component 157 may be a suitable groove, for example, which the actuator 170 interlocks with so as to rotate the driving actuator gear 152.

Figure 7:
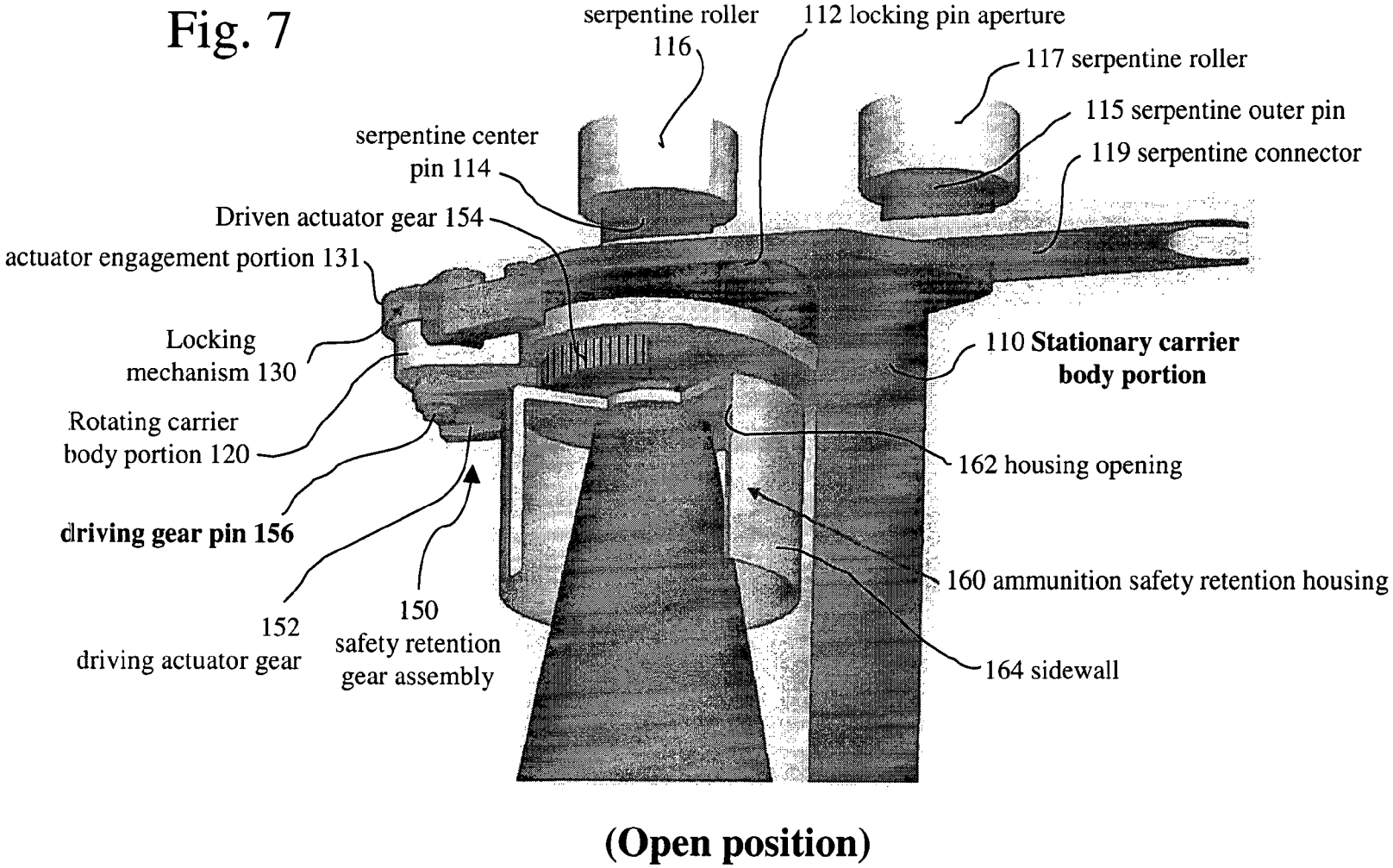
FIG. 7 is a perspective view showing further aspects of an ammunition carrier with locking mechanism in the open position in accordance with one embodiment of the invention.

FIG. 7 is a perspective view showing the rotating carrier body portion 120 in the open position and the locking mechanism 130 disengaged from the stationary carrier body portion 110. FIG. 7 also shows further aspects of the safety retention gear assembly 150. Specifically, FIG. 7 shows the driving actuator gear 152, as well as a driven actuator gear 154. Both the driving actuator gear 152 and the driven actuator gear 154 are provided with suitable teeth such that rotation of the driving actuator gear 152 results in rotation of the driven actuator gear 154. The driven actuator gear 154 is non-rotateably fixed to the ammunition safety retention housing 160. Accordingly, rotation of the driven actuator gear 154 results in the rotation of the ammunition safety retention housing 160, exposing the ammunition for removal.

The arrangement of the ammunition carrier 100 provides for a novel process to expose the ammunition. The first step to expose the ammunition is to depress the locking mechanism 130 such that the locking pin 136 disengages from the locking pin aperture 112. Then, the rotating carrier body portion 120 is rotated relative to the stationary carrier body portion 110. Thereafter, the driving gear pin 156 is rotated so as to rotate the driving actuator gear 152. Rotation of the driving actuator gear 152 in turn rotates the driven actuator gear 154. Since the driven actuator gear 154 is fixed to the ammunition safety retention housing 160, the ammunition safety retention housing 160 is rotated so as to fully expose the ammunition. The rotation of the ammunition safety retention housing 160 may be performed as the very last step in the case where the ammunition is to be removed.

FIGS. 8-11 show further aspects of the actuator 170, in accordance with one embodiment of the invention. As noted above, the actuator 170 includes an actuator handle 173. The actuator handle 173 is manipulated by an operator to control the actuator 170. The actuator 170 includes a plunger sleeve 174. Housed within the plunger sleeve 174 is an engagement plunger 175. The engagement plunger 175 is vertically movable within the plunger sleeve 174. Such vertical movement allows an engagement collar 176 to be engaged with the locking mechanism 130. The engagement collar 176 is an integral part of the engagement plunger 175.

Figure 12:
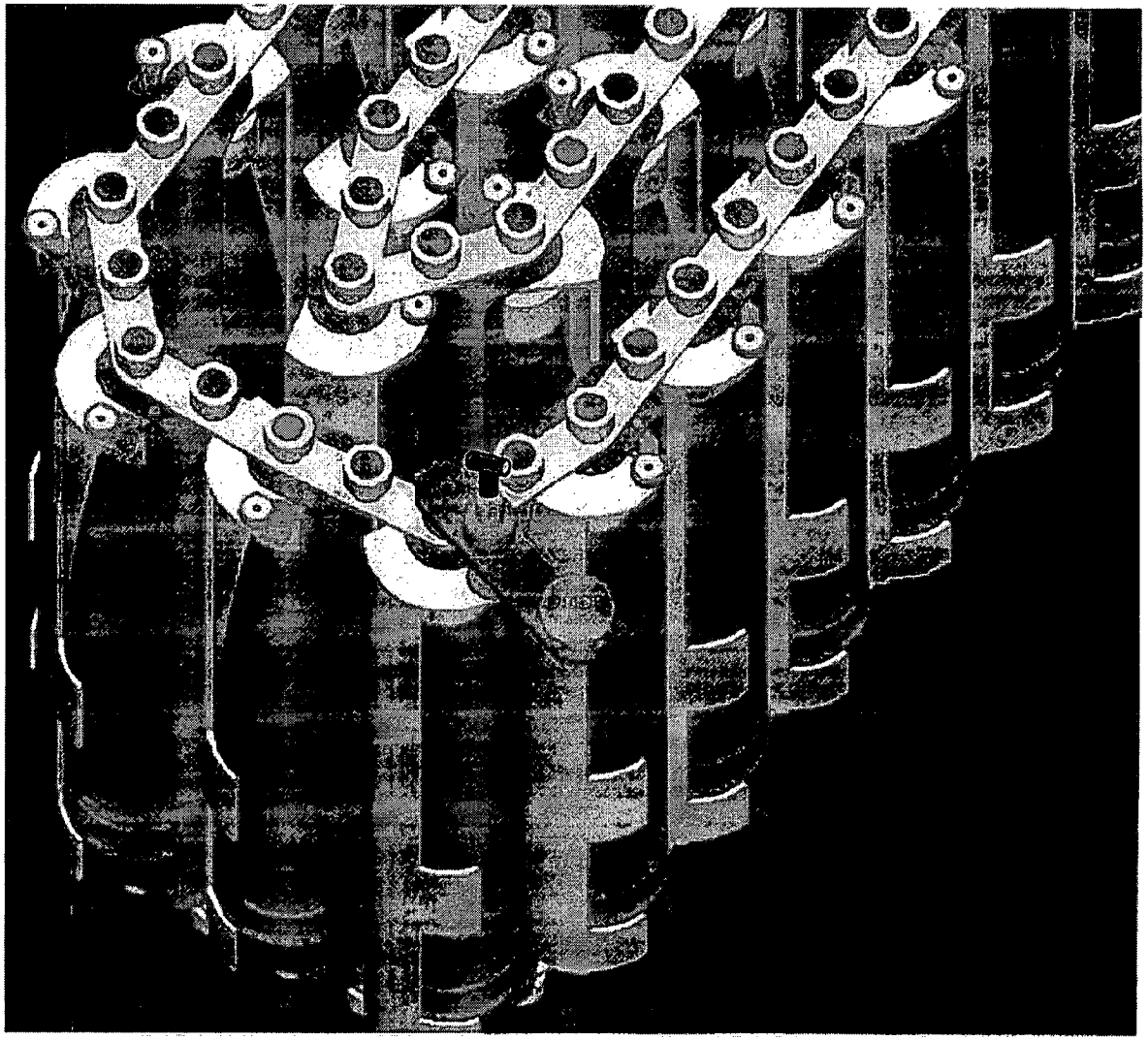
FIG. 12 is a perspective view of the ammunition carrier with actuator in an ammunition handling system in accordance with one embodiment of the invention.

That is, as the particular ammunition carrier 100 is positioned under the engagement plunger 175 (as shown in FIG. 12), the operator depresses the engagement plunger 175 so as to engage the engagement collar 176 with the locking mechanism 130. Specifically, the engagement collar 176 is engaged with an actuator engagement portion 131 (of the locking mechanism 130). Once engaged, the operator continues to depress the actuator 170 so as to disengage the locking pin 136 from the locking pin aperture 112. The operator then rotates the actuator 170 so as to rotate the rotating carrier body portion 120 relative to the stationary carrier body portion 110.

The operator then has access to the ammunition. The operator then decides whether it is desired to actually release the ammunition for unload, i.e., open the ammunition safety retention housing 160. If the operator does wish to release the ammunition, the operator uses a gear driver 178.

Figure 8:
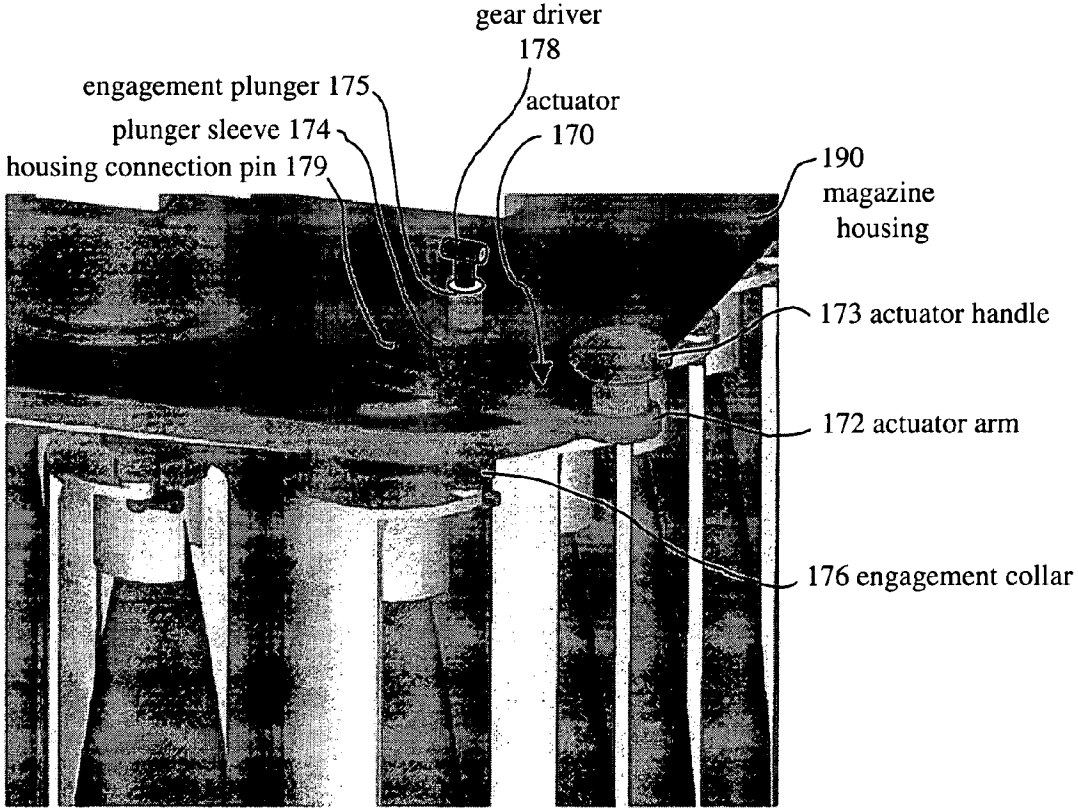
FIG. 8 is a perspective view showing an actuator with the ammunition carrier in the closed position in accordance with one embodiment of the invention.
Figure 9:
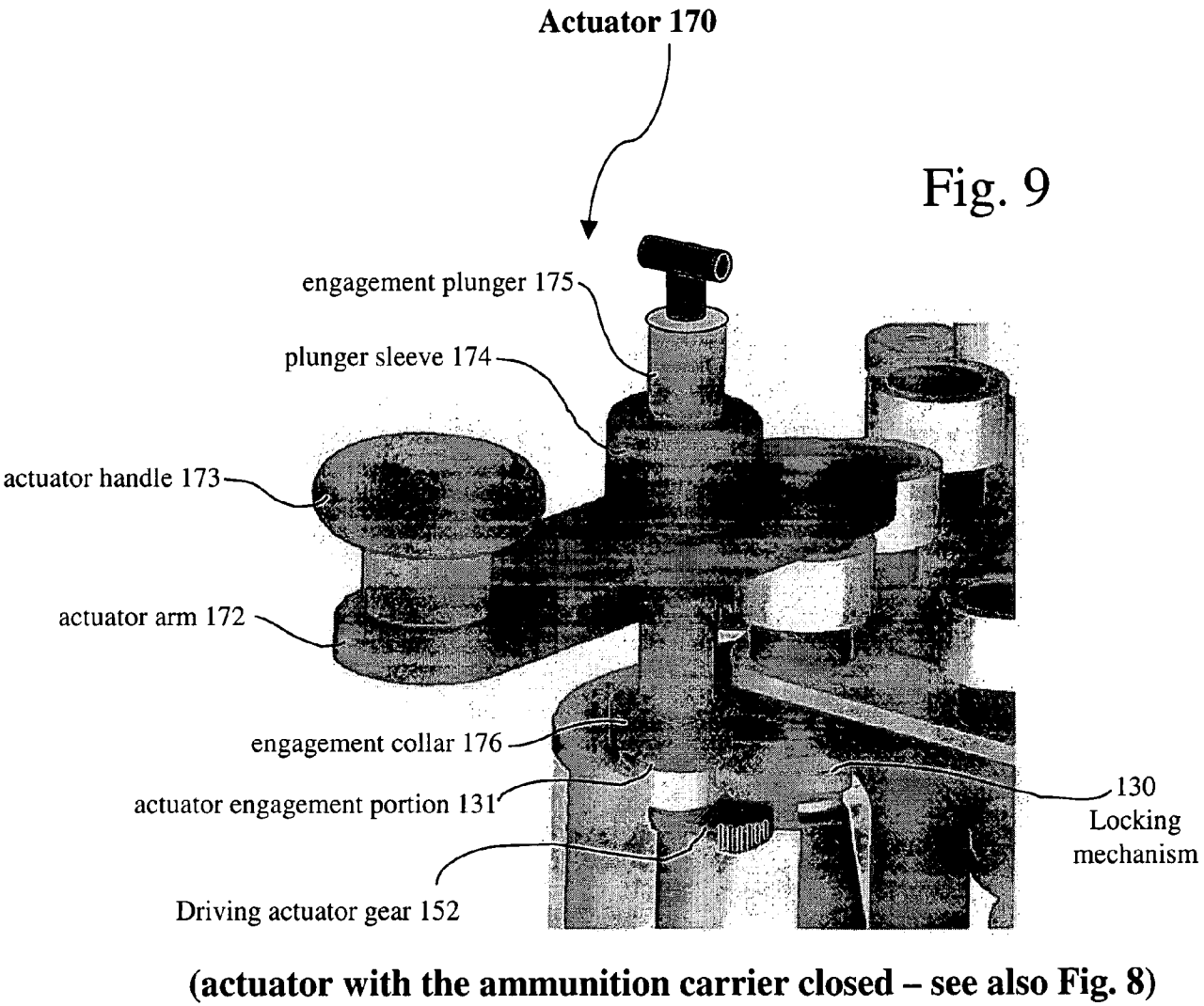
FIG. 9 is a perspective view further showing an actuator with the ammunition carrier in the closed position in accordance with one embodiment of the invention.
Figure 10:
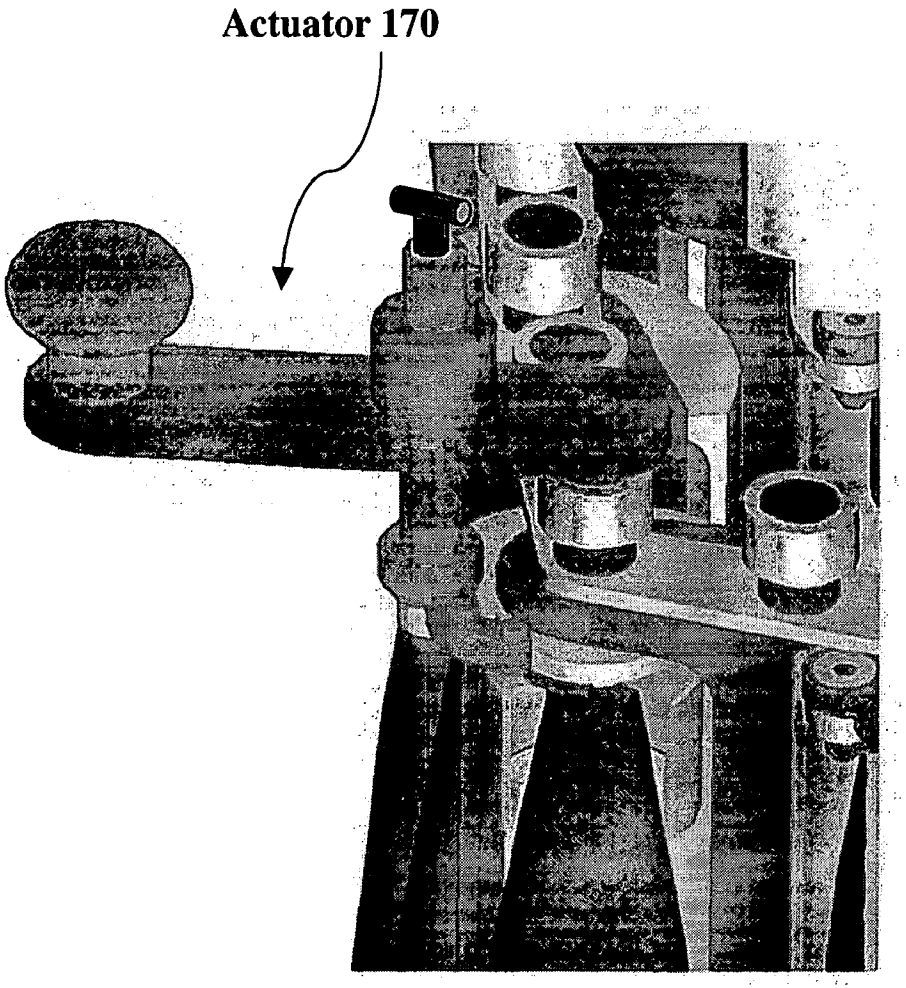
FIG. 10 is a perspective view showing an actuator with the ammunition carrier in the open position in accordance with one embodiment of the invention.

To explain, FIG. 8 shows the gear driver 178. The gear driver 178 may be in the form of a rod housed within the engagement plunger 175. One end of the gear driver 178 is fitted with a handle as shown in FIG. 8. The other end of the rod is adapted to engage the pin engagement component 157 (as shown in FIG. 6). Accordingly, by the operator rotating the gear driver 178, the operator effects rotation of the driving gear pin 156, the driving actuator gear 152 and in turn the driven actuator gear 154. This results in the opening of the ammunition safety retention housing 160.

It is appreciated that other arrangements may be used to effect the independent rotation of the locking mechanism 130 and driving gear pin 156. The invention is not limited to the particular arrangement of the actuator 170 shown in FIG. 8. For example, a motorized actuator assembly might be used to rotate carrier body portion 120 and operatively engage with the gear driver 178. Another motorized arrangement is described below.

Figure 13:
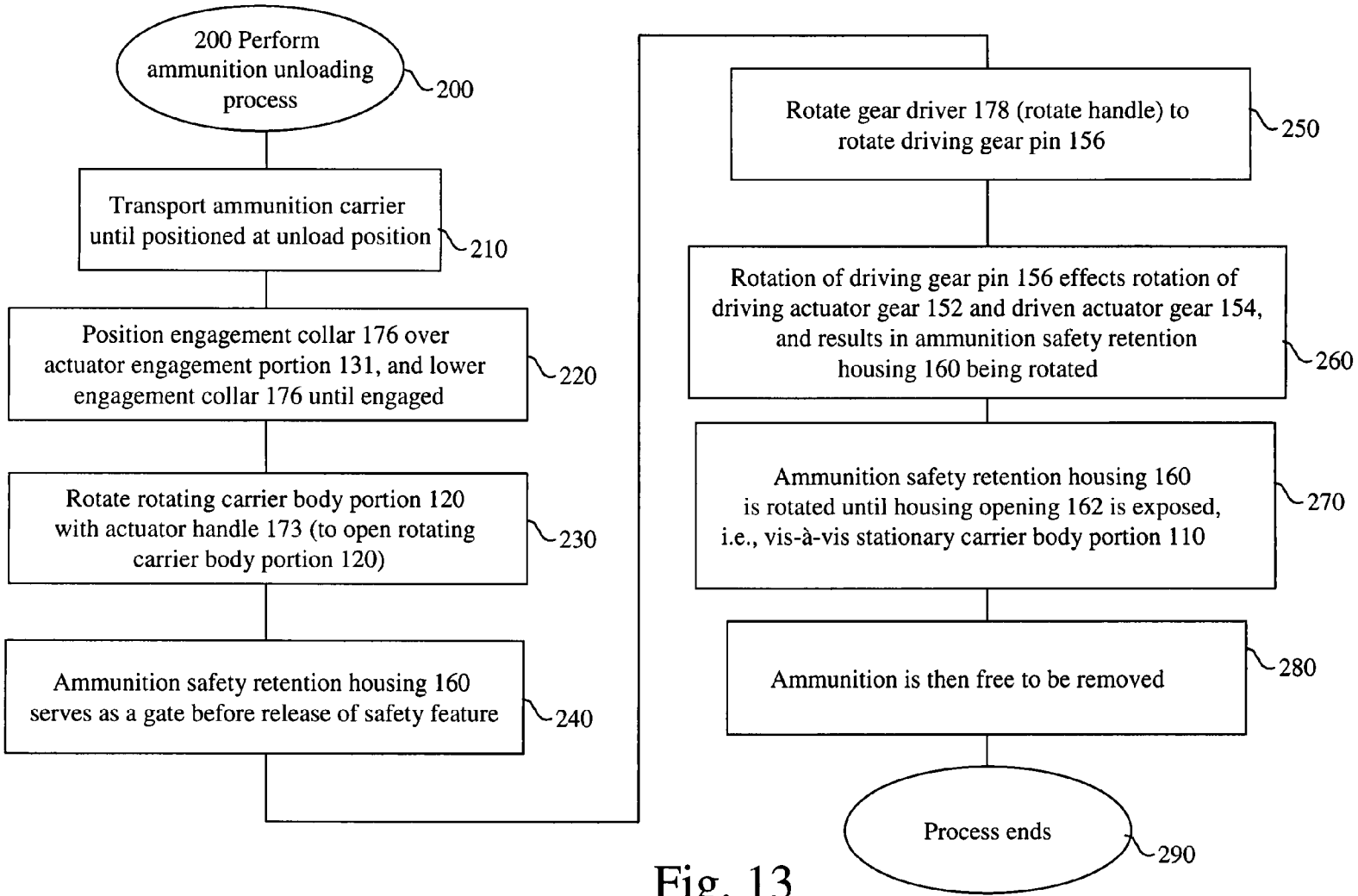
FIG. 13 is a flowchart showing an ammunition unloading process in accordance with one embodiment of the invention.

Hereinafter, further aspects of embodiments will be described with reference to FIG. 13. FIG. 13 is a flowchart showing an unloading process in accordance with one embodiment of the invention. As shown in FIG. 13, the process starts in step 200 and passes to step 210. In step 210, the ammunition carrier is transported until positioned at an unload position. This transport may be performed using a suitable ammunition handling system, equipped with features of the invention.

Then, in step 220, the engagement collar 176 is positioned over the actuator engagement portion 131 of the locking mechanism 130. The engagement collar 176 is then lowered until engaged with the actuator engagement portion 131.

Then, in step 230 the carrier body portion 120 is rotated using the actuator handle 173 (to open rotating carrier body portion 120). As shown in FIG. 8, this rotation would be clockwise. Step 240 of FIG. 13 reflects that the ammunition safety retention housing 160 serves as a gate, i.e., a safety feature. That is, until the ammunition safety retention housing 160 is rotated so as to release the ammunition, the ammunition is still secured by the ammunition safety retention housing 160.

In this example, it is concluded that the ammunition should be released. Accordingly, in step 250, the gear driver 178, i.e., the handle, is rotated to rotate the driving gear pin 156. For example, the gear driver 178 is rotated counterclockwise as shown in FIG. 7. As shown in step 260 of FIG. 13, rotation of driving gear pin 156 effects rotation of driving actuator gear 152 and driven actuator gear 154, and results in ammunition safety retention housing 160 being rotated. The ammunition safety retention housing 160 is rotated (step 270) until housing opening 162 is exposed, i.e., vis-à-vis stationary carrier body portion 110. In step 280, the ammunition is then free to be removed. In step 290, the process ends.

Figure 11:
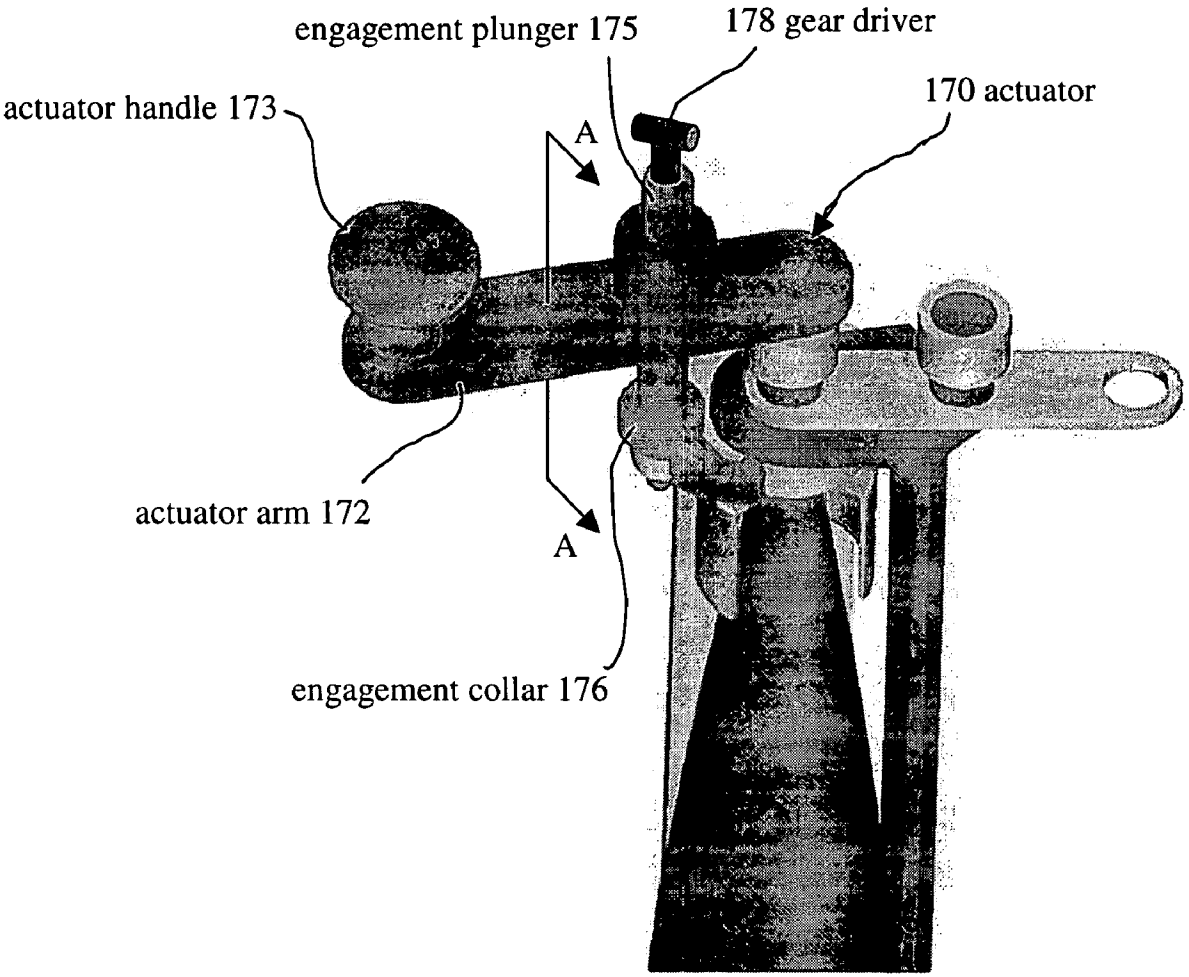
FIG. 11 is a perspective view further showing an actuator with the ammunition carrier in the open position in accordance with one embodiment of the invention.
Figure 14:
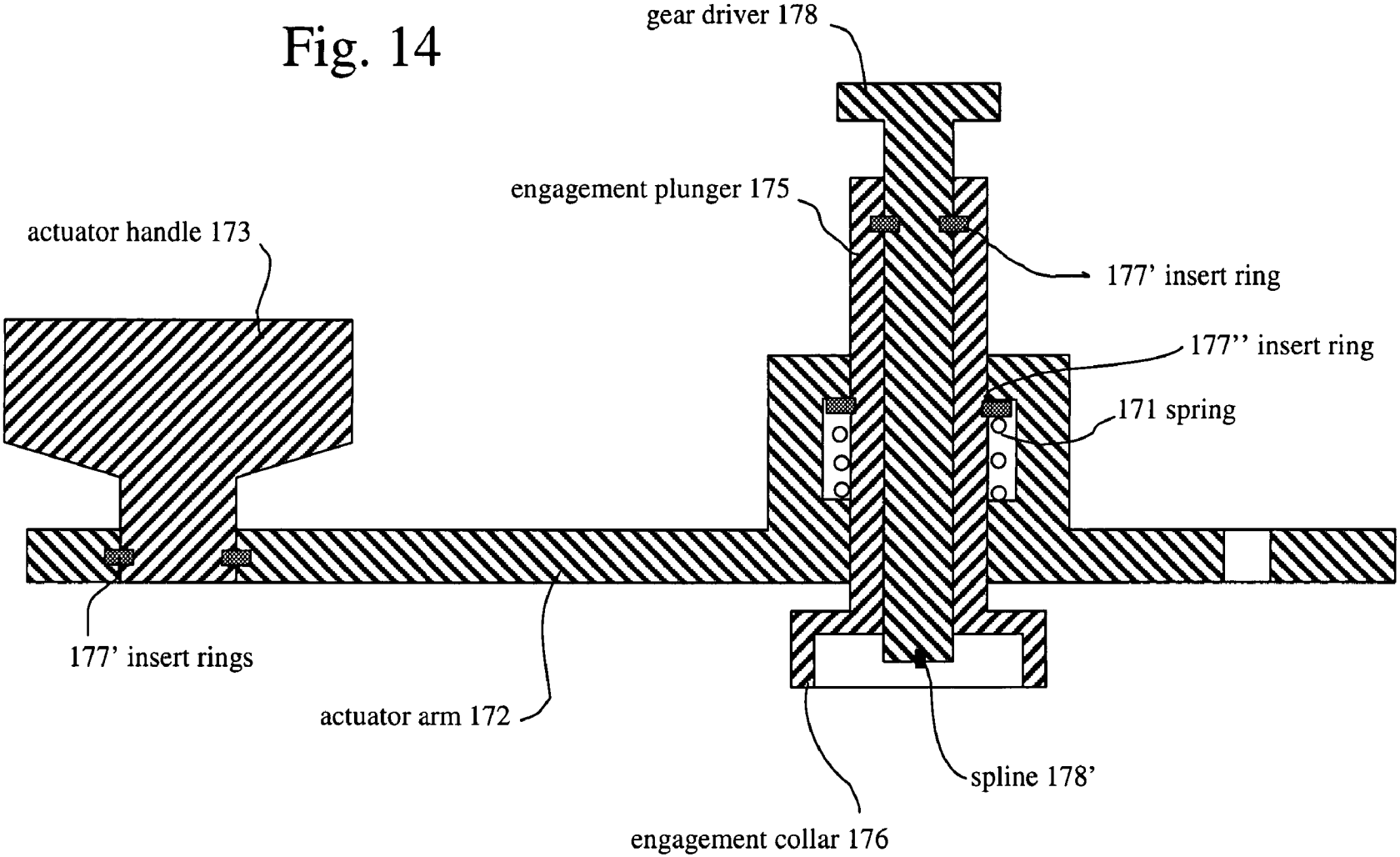
FIG. 14 is a cross sectional diagram showing the actuator of FIG. 11 along line A-A in accordance with one embodiment of the invention.

In further explanation of embodiments, FIG. 14 is a cross sectional diagram showing the actuator 170 of FIG. 11 along line A-A in accordance with one embodiment of the invention. FIG. 14 shows details of the internal structure of the actuator 170. The actuator handle 173 may be fixed to the actuator arm 172 in a suitable manner, for example, so as to allow rotation within the actuator arm 172. For example, insert ring 177 might be used to secure the actuator handle 173 in the actuator arm 172, while allowing relative rotation.

FIG. 14 also shows the gear driver 178 disposed in the engagement plunger 175; and the engagement plunger 175 disposed in the actuator arm 172. Such components may also be secured to each other using suitable insert rings 177. That is, the insert ring 177' allows rotation between the gear driver 178 and the engagement plunger 175, but does not allow telescopic movement. On the other hand, insert ring 177" allows rotational movement between the engagement plunger 175 and the actuator arm 172, as well as limited telescopic movement, i.e., such that engagement collar 176 may be moved down to engage the locking mechanism 130. A suitable spring 171 may be used to bias engagement plunger 175 to an up (disengaged) position.

As shown in FIG. 14, the gear driver 178 may be provided with a suitable spline 178'. The spline 178' is provided to engage with the pin engagement component 157 (of the driving gear pin 156) as shown in FIG. 6, i.e., so as to rotate the driving gear pin 156, as described herein.

Figure 15:
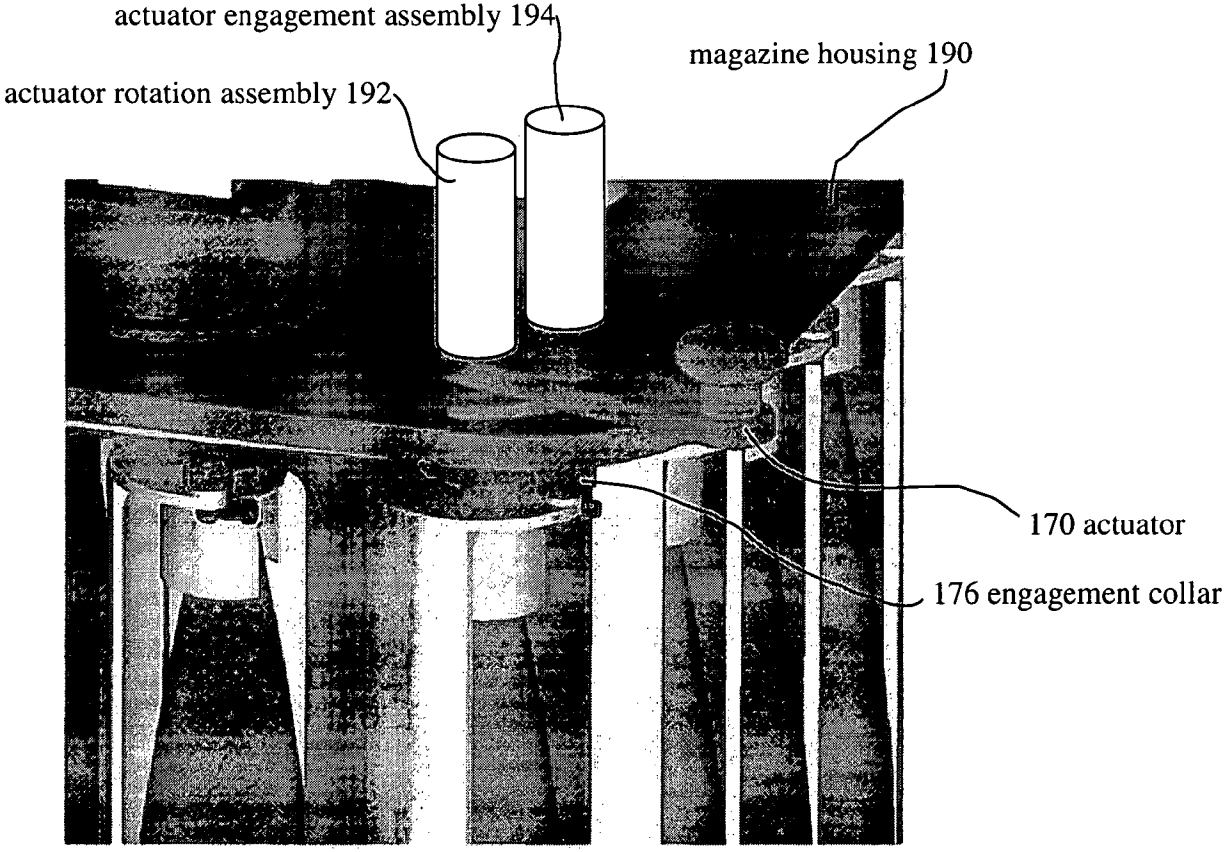
FIG. 15 is the actuator of FIG. 8 modified to be automated (motorized) in accordance with one embodiment of the invention.

With regard to further aspects of the invention, FIG. 15 is the actuator of FIG. 8 modified to be automated in accordance with one embodiment of the invention. It is appreciated that any suitable arrangement may be provided to effect the above described movement of the actuator 170, and the various components thereof. In accordance with one embodiment of the invention, FIG. 15 shows an actuator rotation assembly 192. The actuator rotation assembly 192 may be in the form of a suitable motor arrangement for rotating the actuator 170 relative to the magazine housing 190. FIG. 15 also shows actuator engagement assembly 194. The actuator engagement assembly 194 may be in the form of a suitable motor arrangement to effect telescope movement of the engagement plunger 175 within the plunger sleeve 174, and to effect rotation of the gear driver 178 within the engagement plunger 175. Such rotation of the gear driver 178 effects rotation of the driving actuator gear 152, as described above. The assemblies (192, 194) may be provided with suitable gears, solenoids, etc., as may be desired. Further, the actuator engagement assembly 194 and the actuator rotation assembly 192 may be provided to effect other desired automated actuation, as is well within the purview of one of ordinary skill in the art based on the disclosure set forth herein.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. An ammunition carrier for retaining ammunition, the ammunition carrier comprising:

a stationary carrier body portion disposed about a space in which to retain the ammunition;

a rotating carrier body portion disposed about the space and pivotally attached to the stationary carrier body portion, the stationary carrier body portion and the rotating carrier body portion collectively forming a cover assembly to secure the ammunition;

a locking mechanism, the locking mechanism pivotally attached to the rotating carrier body portion, the locking mechanism:

engageable, in an engaged position, with the stationary carrier body portion so as to prevent rotation of the rotating carrier body portion relative to the stationary carrier body portion; and disengageable, in a disengaged position, with the stationary carrier body portion so as to allow rotation of the rotating carrier body portion relative to the stationary carrier body portion;

an ammunition safety retention housing disposed in the space, the ammunition safety retention housing for further securing the ammunition and pivotally attached to the stationary carrier body portion, the ammunition safety retention housing including a sidewall with a sidewall opening in the sidewall through which ammunition may be passed, the ammunition safety retention housing rotateable from a closed position, in which the sidewall opening is positioned adjacent the stationary carrier body portion, to an open position, in which the sidewall opening is exposed to allow removal of ammunition; and a gear assembly including a driving actuator gear pivotally attached to the rotating carrier body portion and a driven actuator gear attached to the ammunition safety retention housing, wherein rotation of the driving actuator gear effects rotation of the driven actuator gear and the ammunition safety retention housing.

2. The ammunition carrier of claim 1, further including a driving gear pin on which the driving actuator gear is mounted, the driving gear pin pivotally disposed in the locking mechanism.

3. The ammunition carrier of claim 2, further including an actuator, the actuator engageable with the driven gear pin so as to rotate the driven gear pin.

4. The ammunition carrier of claim 3, wherein the actuator is engageable with the locking mechanism to operatively move the locking mechanism from the engaged position to the disengaged position.

5. The ammunition carrier of claim 4, the locking mechanism further including a carrier collar, and the locking mechanism including a locking mechanism collar, the locking mechanism collar rotateably disposed about the carrier collar.

6. The ammunition carrier of claim 5, wherein the driving gear pin is rotateably disposed in the carrier collar.

7. The ammunition carrier of claim 1, further including an actuator, the actuator engageable with the locking mechanism to operatively move the locking mechanism from the engaged position to the disengaged position.

8. The ammunition carrier of claim 7, wherein the locking mechanism includes a locking pin and the stationary carrier body portion includes a locking pin aperture, the locking pin disposed in the locking pin aperture when the locking mechanism is disposed in the engaged position.

9. A method for operating an ammunition carrier for retaining ammunition, the method comprising:

providing a stationary carrier body portion disposed about a space in which to retain the ammunition;

providing a rotating carrier body portion disposed about the space and pivotally attached to the stationary carrier body portion, the stationary carrier body portion and the rotating carrier body portion collectively forming a cover assembly to secure the ammunition; and providing a locking mechanism, the locking mechanism pivotally attached to the rotating carrier body portion;

engaging, using the locking mechanism, the rotating carrier body portion with the stationary carrier body portion so as to prevent rotation of the rotating carrier body portion relative to the stationary carrier body portion;

disengaging, using the locking mechanism, the rotating carrier body portion with the stationary carrier body portion so as to allow rotation of the rotating carrier body portion relative to the stationary carrier body portion;

providing an ammunition safety retention housing disposed in the space, the ammunition safety retention housing securing the ammunition and pivotally attached to the stationary carrier body portion, the ammunition safety retention housing including a sidewall with a sidewall opening in the sidewall through which ammunition may be passed; and rotating the ammunition safety retention housing rotateable from a closed position, in which the sidewall opening is positioned adjacent the stationary carrier body portion, to an open position, in which the sidewall opening is exposed to allow removal of ammunition wherein the rotating the ammunition safety retention housing is performed using a gear arrangement, the gear arrangement operatively connecting the locking mechanism with the ammunition safety retention housing.

10. The method of claim 9, including:

effecting a first rotational motion to open the rotating carrier body portion relative to the stationary carrier body portion; and effecting a second rotational motion to effect rotation of the ammunition safety retention housing.

11. An ammunition carrier for retaining ammunition, the ammunition carrier comprising:

a stationary carrier body portion disposed about a space in which to retain the ammunition;

a rotating carrier body portion disposed about the space and pivotally attached to the stationary carrier body portion, the stationary carrier body portion and the rotating carrier body portion collectively forming a cover assembly to secure the ammunition; and a locking mechanism, the locking mechanism pivotally attached to the rotating carrier body portion, the locking mechanism:

engageable, in an engaged position, with the stationary carrier body portion so as to prevent rotation of the rotating carrier body portion relative to the stationary carrier body portion; and disengageable, in a disengaged position, with the stationary carrier body portion so as to allow rotation of the rotating carrier body portion relative to the stationary carrier body portion;

a gear assembly, the gear assembly including a driving actuator gear pivotally attached to the rotating carrier body portion and a driven actuator gear attached to the ammunition safety retention housing, wherein rotation of the driving actuator gear effects rotation of the driven actuator gear and the ammunition safety retention housing; and a driving gear pin on which the driving actuator gear is mounted, the driving gear pin pivotally disposed in the locking mechanism and an actuator, the actuator engageable with the driven gear pin so as to rotate the driven gear pin.

* * * * *